US007488211B2

(12) United States Patent
Yamaoka

(10) Patent No.: US 7,488,211 B2
(45) Date of Patent: Feb. 10, 2009

(54) TERMINAL FITTING AND A SHIELD TERMINAL

(75) Inventor: Atsushi Yamaoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/732,053

(22) Filed: Apr. 2, 2007

(65) Prior Publication Data

US 2007/0238353 A1 Oct. 11, 2007

(30) Foreign Application Priority Data

Apr. 10, 2006 (JP) ..... 2006-107851

(51) Int. Cl.
*H01R 13/40* (2006.01)

(52) U.S. Cl. ..... 439/595; 439/733.1; 439/851

(58) Field of Classification Search ..... 439/595, 439/733.1, 752, 842, 843, 851
See application file for complete search history.

(56) References Cited

U.S. PATENT DOCUMENTS 5,542,861 A * 8/1996 Anhalt et al. ..... 439/578
6,210,223 B1 * 4/2001 Aoyama et al. ..... 439/585
6,254,430 B1 * 7/2001 Endo et al. ..... 439/578
6,589,080 B2 * 7/2003 Tanaka ..... 439/595
6,679,738 B2 * 1/2004 Nimura ..... 439/852
6,808,417 B2 * 10/2004 Yoshida ..... 439/585
2002/0106917 A1 8/2002 Koide et al.

* cited by examiner

*Primary Examiner*—Tho D Ta
*Assistant Examiner*—Travis Chambers
(74) *Attorney, Agent, or Firm*—Gerald E. Hespos; Anthony J. Casella

(57) ABSTRACT

An outer conductor (40) of a shield terminal (T) used by being connected with a shielded cable (10) is provided with a stabilizer (46) folded at an intermediate position such that an extending end thereof faces a main portion (41). Thus, even if shield terminals (T) touch each other during transportation, inadvertent deformations of tongue pieces (44) and the stabilizer (46) can be prevented since the leading end of the stabilizer (46) is a folded end to have a larger thickness as compared to conventional ones and is unlikely to enter a slit (43) of another outer conductor (40) or get caught thereby.

4 Claims, 8 Drawing Sheets

TERMINAL FITTING AND A SHIELD TERMINAL

BACKGROUND OF THE INVENTION

1. Field of the Invention

The invention relates to a terminal fitting and to a shield terminal.

2. Description of the Related Art

Description of the Related Art, U.S. Patent Application Publication No. 2002/0106917 A1 discloses a terminal fitting with a rectangular tubular main portion and a cantilevered tongue that is formed by making a slit in a side of the main portion. A side of the main portion is bent out to form a stabilizer at the end of the main portion that is to be connected with a wire.

This terminal fitting is inserted into a rectangular cavity that has a guiding groove for receiving the stabilizer when the terminal fitting is oriented properly. However, the stabilizer interferes with the opening edge of the cavity to prevent the terminal fitting from being inserted in an improper orientation.

Terminal fittings generally are packed together and transported from a production site to an assembling site. The terminal fittings typically are connected with ends of wires at the assembly site and are bundled together for transport to the next processing location. The stabilizer of one terminal fitting easily can enter the slit of another terminal fitting during transit, and this contact may inadvertently deform the tongue and the stabilizer.

The invention was developed in view of the above problem, and an object of the invention is to prevent inadvertent deformations of a tongue or a stabilizer due to the engagement of the stabilizer of one terminal fitting in a slit of another terminal fitting.

SUMMARY OF THE INVENTION

The invention relates to a terminal fitting with a wire connecting portion configured for connection with a wire and a main portion configured for insertion into a cavity of a housing. The terminal fitting preferably is punch formed form a single piece of metal. At least one tongue is formed by making a slit in the main portion. A stabilizer extends out from the main portion and preferably is plate-shaped. The stabilizer is folded back at an intermediate position so that an extending end of the stabilizer substantially faces the main portion. Accordingly, the outer folded end of the stabilizer has a larger thickness as compared to conventional stabilizers and is unlikely to enter a slit of another terminal fitting. The cut end of the stabilizer is likely to have a fractured surface caused by the punching of the metal plate. However, the cut end faces the main portion, and therefore is less likely to get caught by the slit in another terminal as compared to the case where the fractured surface faces out. Accordingly, the stabilizer of one terminal fitting is not likely to enter the slit of another terminal fitting and inadvertent deformations of the tongue and the stabilizer can be prevented.

The stabilizer preferably is formed at or near a front end of the main portion with respect to an inserting direction. Accordingly, an attempt to insert the terminal fitting in an improper orientation is noticed soon.

The main portion may be substantially cylindrical and the stabilizer may also function as a stopper for preventing turning of the main portion. Accordingly, the construction of the terminal fitting can be simplified as compared to a case where the stopper and the stabilizer are separate.

The terminal fitting preferably is used a shield terminal that can be connected with an end of a shielded cable that has a core covered by a shielding layer. The shield terminal preferably has an inner conductor configured for connection with the core, a dielectric element configured for accommodating the inner conductor, and an outer conductor configured for accommodating the dielectric element and for connection with the shielding layer. The terminal fitting preferably is the outer conductor of the shield terminal and the wire connecting portion of the terminal fitting is configured for crimped connection with the shielding layer. The main portion of the terminal fitting preferably is configured to accommodate the dielectric element. The tongue of the terminal fitting is configured for contacting a mating terminal.

The stabilizer preferably is folded back closely at least once.

The fold of the stabilizer preferably defines the leading end thereof.

The stabilizer preferably is folded at an intermediate position so that an extending end of the stabilizer is arranged at an angle to a base end.

The folded end of the stabilizer preferably is at least twice as thick as the metal plate. Additionally, the stabilizer may be shaped so that the thickness gradually increases at positions closer to the main body.

The invention also relates to the assembly of the above-described terminal fitting and the above-described shield terminal.

These and other objects, features and advantages of the invention will become more apparent upon reading of the following description of preferred embodiments and accompanying drawings.

DETAILED DESCRIPTION OF THE PREFERRED EMBODIMENTS

Figure 1:
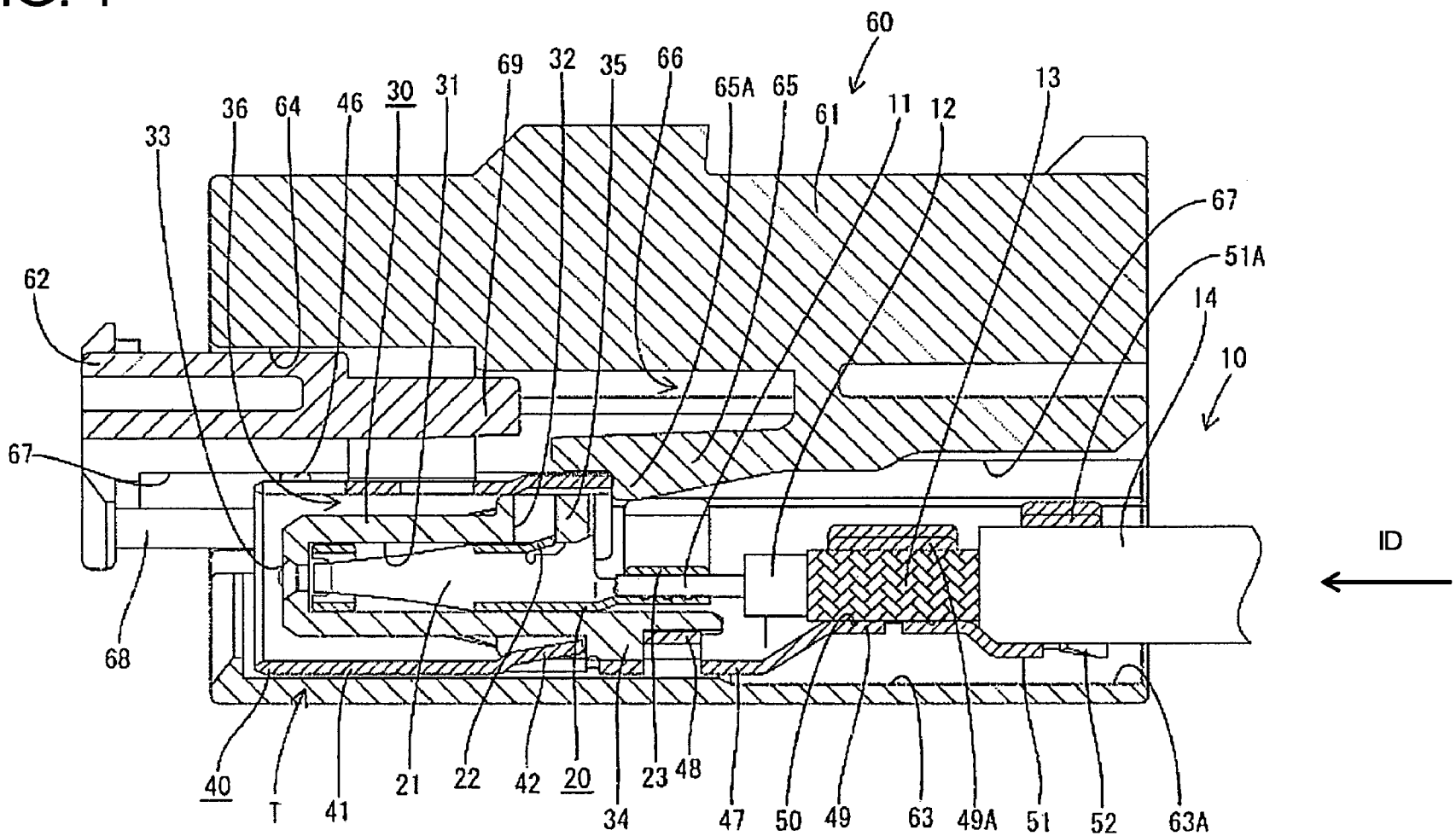
FIG. 1 is a side view in section showing a state where a shield terminal according to a first embodiment is inserted in a cavity.
Figure 2:
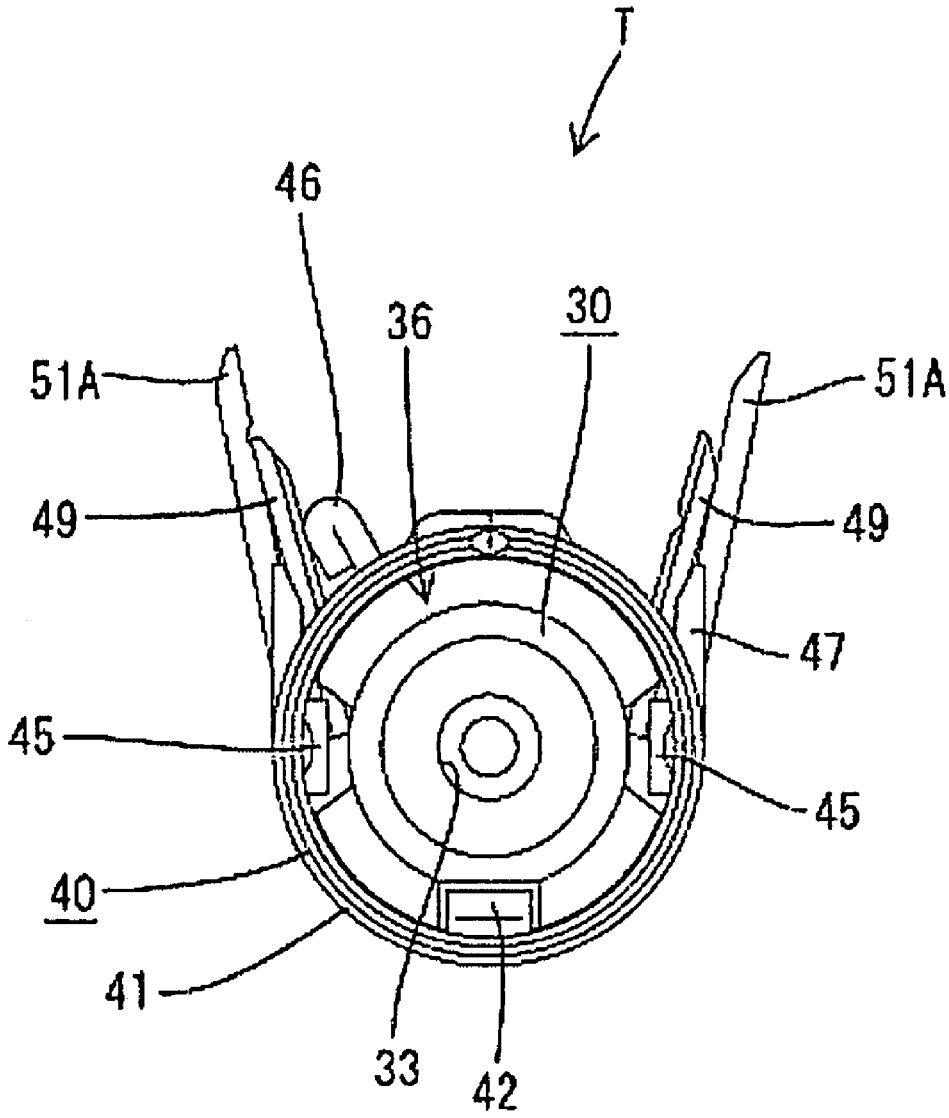
FIG. 2 is a front view of the shield terminal of the first embodiment.

A shield terminal according to a first embodiment of the invention is identified by the letter T in FIGS. 1 to 7. The shield terminal T can be connected with an end of a shielded cable 10 and can be inserted in a cavity 63. In the following description, an inserting direction ID of the shield terminal T into the cavity 63 is referred to as forward direction and reference is made to FIG. 1 for upper and lower sides.

The shielded cable 10 has: a core 11 formed by bundling wires, an inner cover 12 that covers the core 11, a braided wire 13 that surrounds the inner cover 12, and an outer cover 14 that covers the braided wire 13. An end of this shielded cable 10 is processed so that the braided wire 13 and the core 11 are exposed. The braided wire 13 preferably is formed by braiding a thin electrically conductive metallic wire.

The shield terminal T includes an inner conductor 20 to be connected with the core 11 of the shielded cable 10. The inner conductor 20 is formed by bending, folding or embossing an electrically conductive metal plate punched or cut out into a specified shape. This inner conductor 20 is in the form of a female terminal, and includes a rectangular tubular connecting portion 21 for receiving a tab of a mating inner conductor in the form of a male terminal (not shown). A locking piece 22 is formed near the rear end of the connecting portion 21 and two core crimping pieces 23 are formed behind the connecting portion 21. The core crimping pieces 23 can be crimped, bent or folded into connection with the core 11 of the shielded cable 10.

The shield terminal T further includes a dielectric element 30 that accommodates the inner conductor 20 and that is insertable into an outer conductor 40. Thus, the dielectric element 30 is interposed between the inner and outer conductors 20, 40 and electrically insulates the conductors 20, 40.

The dielectric element 30 is made of an insulating material, e.g. synthetic resin, and is in the form of a thick-walled cylinder. An accommodating hole 31 is formed in the dielectric element 30 for accommodating the connecting portion 21 of the inner conductor 20, and a locking hole 32 is formed at a position of the accommodating hole 31 corresponding to the locking piece 22 of the inner conductor 20 for engaging the locking piece 22. The locking hole 32 penetrates from the accommodating hole 31 to the outer surface of the dielectric element 30. Further, a tab insertion opening 33 is formed at the front end of the dielectric element 30 so that the tab of the mating inner conductor can be inserted into the accommodating hole 31.

A locking projection 34 projects out (down in FIG. 1) from the outer surface of the dielectric element 30 at a position near the rear end of the dielectric element 30. A shake preventing portion 35 projects out (up in FIG. 1) from the outer surface of the dielectric element 30 at a part of the dielectric element 30 where the locking hole 32 is formed. The locking projection 34 fits between a metal lock 42 of the outer conductor 40 and a stopper 48 when the dielectric element 30 is mounted in the outer conductor 40. Additionally the shake preventing portion 35 contacts the inner surface of the outer conductor 40 to position the dielectric element 30. At this time, an insertion space 36 is defined between the outer surface of the dielectric element 30 and the inner surface of the outer conductor 40 for receiving a mating outer conductor.

Figure 5:
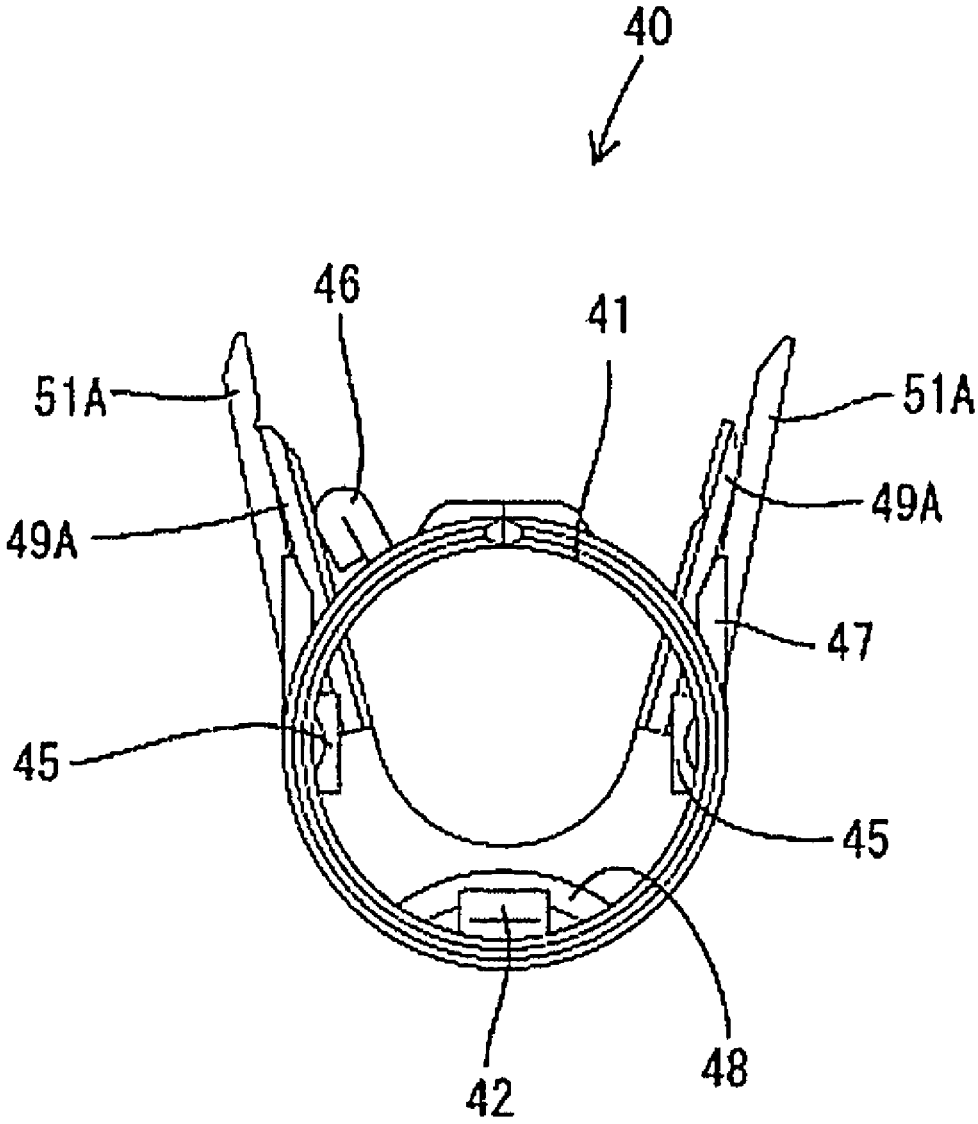
FIG. 5 is a front view of the outer conductor of the first embodiment.
Figure 6:
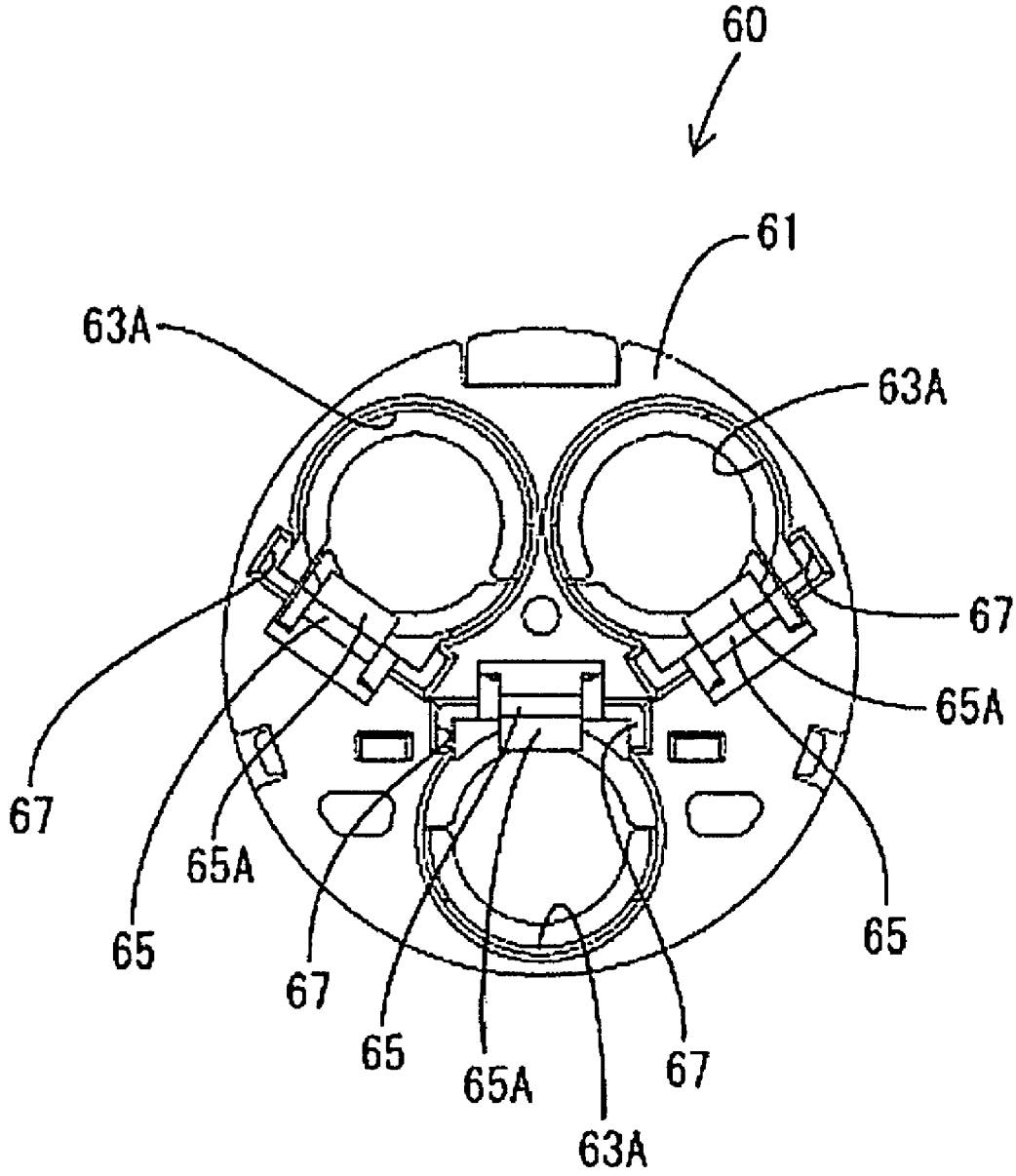
FIG. 6 is a rear view of a connector housing.
Figure 7:
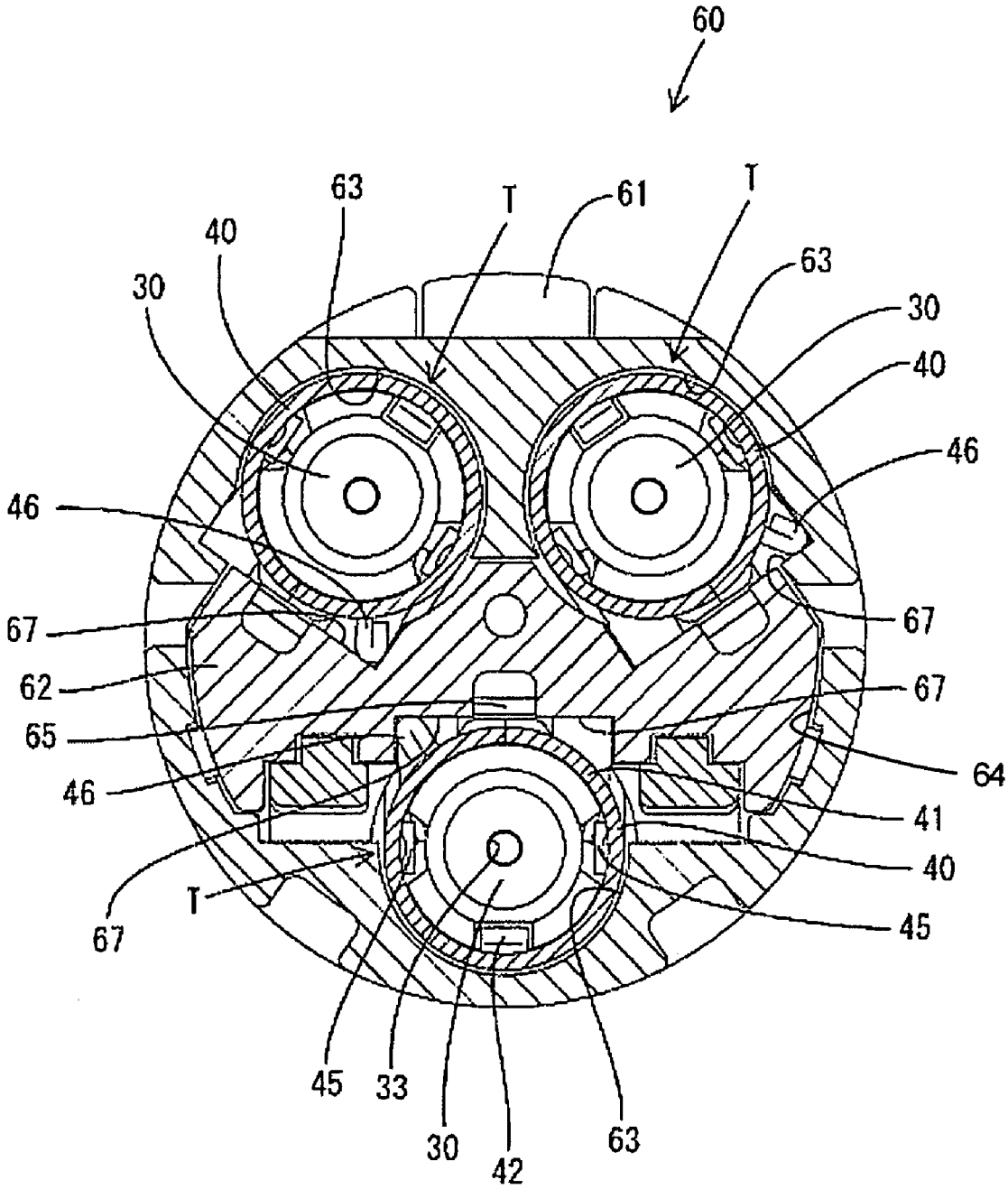
FIG. 7 is a section showing the shield terminals in cavities.

The shield terminal T also includes the outer conductor 40 that accommodates the dielectric element 30 and that can be connected with the braided wire 13 of the shielded cable 10. The outer conductor 40 is formed by bending, folding or embossing an electrically conductive metal plate punched or cut out into a specified shape and includes a main portion 41 for accommodating the dielectric element 30. As shown in FIG. 5, the main portion 41 has a hollow cylindrical shape for receiving the dielectric element 30 from the front. The metal lock 42 is formed by cutting and bending at the rear end of the main portion 41 and cantilevers in and back in the main portion 41. The locking projection 34 of the dielectric element 30 passes the metal lock 42 when the dielectric element 30 is inserted into the main portion 41 from the front. The metal lock 42 then restores resiliently to engage with the locking projection 34 from the front to prevent a forward movement of the dielectric element 30.

Figure 3:
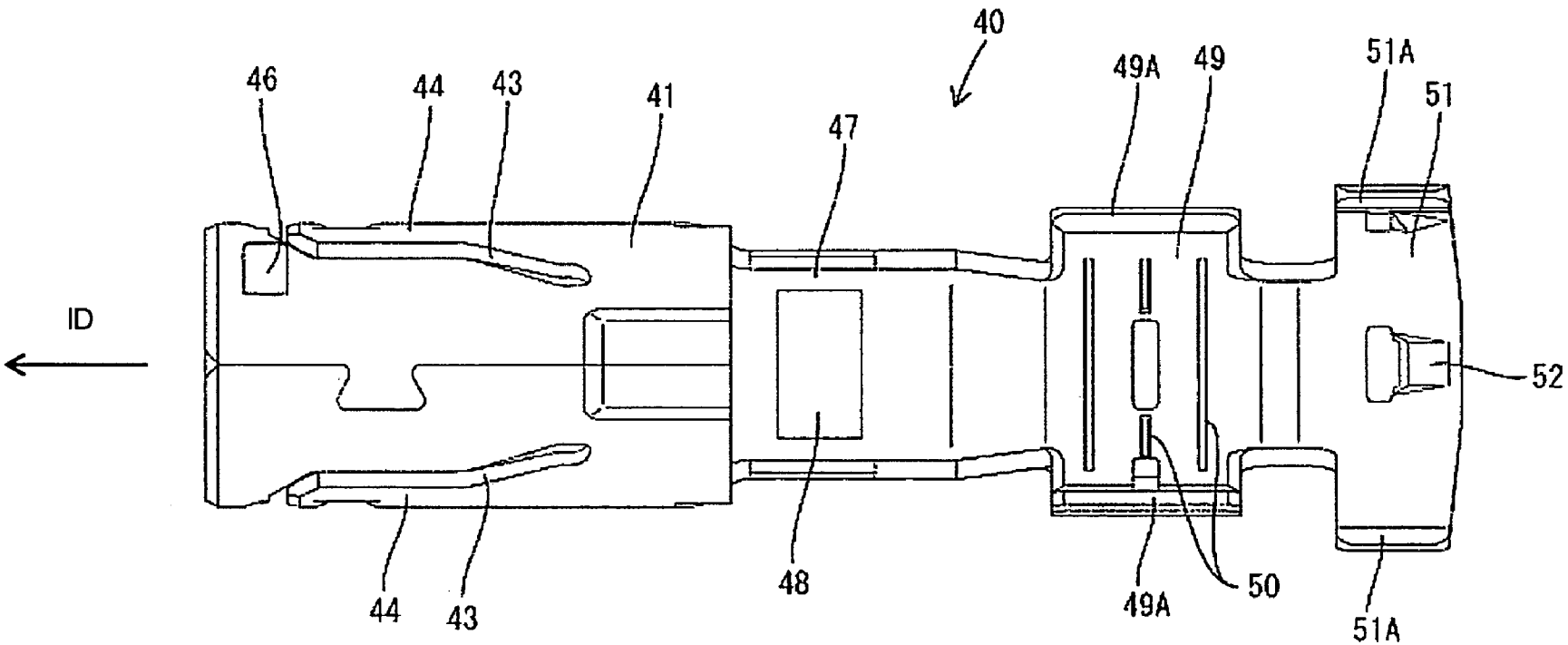
FIG. 3 is a plan view of an outer conductor of the first embodiment.

Two tongue pieces 44 are formed to face each other by forming slits 43 in side walls of the main portion 41. The tongue pieces 44 cantilever forward, as shown in FIG. 3, and are resiliently deformable in and out in directions substantially normal to the inserting direction ID for resiliently touching the mating outer conductor. The tongue pieces 44 are recessed inward of the main portion 41 near their front ends to form contacts 45.

Figure 4:
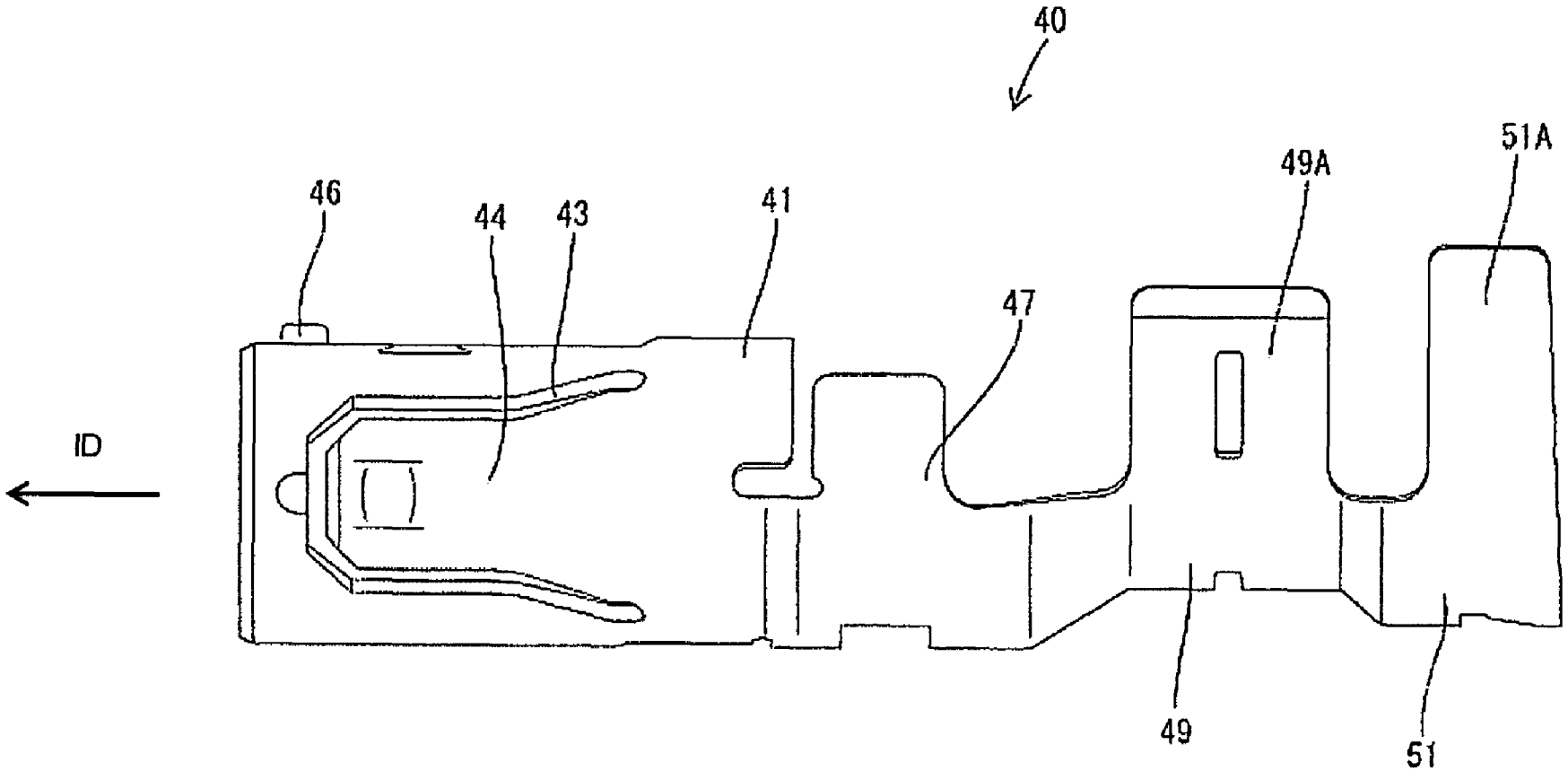
FIG. 4 is a side view of the outer conductor of the first embodiment.

As shown in FIGS. 4 and 5, a stabilizer 46 extends out from a side surface of the main portion 41 at a position near the front end of the main portion 41. The stabilizer 46 is formed by making a cut in a side wall of the main portion 41 and bending the cut portion out at a substantially right angle to the side surface. However, an extending end of the stabilizer 46 is folded back to substantially face the main portion 41. The stabilizer 46 is folded back closely and the resulting folded end serves as the leading end of the stabilizer 46. Further, the folded end is at a position near the side surface of the main portion 41. Thus, the stabilizer 46 is substantially in the form of a plate having about twice the thickness of the metal plate.

A cover 47 is provided continuously behind the main portion 41 and is open at a side where the stabilizer 46 is provided (upper side in FIG. 4). The cover 47 corresponds to the position of the core crimping pieces 23 of the inner conductor 20, and covers lateral sides of the core crimping pieces 23. A stopper 48 is provided on a surface of the cover 47 at a side (bottom in FIG. 4) opposite to the open side as shown in FIGS. 1 and 5 projecting toward the open side. This stopper 48 prevents a backward movement of the dielectric element 30 by contacting the locking projection 34 of the dielectric element 30 from behind.

A braided wire crimping portion 49 is provided behind to the cover 47 and can be crimped, bent or folded into connection with the braided wire 13 of the shielded cable 10. The braided wire crimping portion 49 includes two braided wire crimping pieces 49A that are open at the upper side (side where the stabilizer 46 is provided) before being crimped, bent or folded into connection with the shielded cable 10, as shown in FIG. 4. The braided wire crimping pieces 49A are wound around the braided wire 13 by placing an end of one braided wire crimping piece 49A on that of the other braided wire crimping piece 49A (see FIG. 1). The braided wire crimping portion 49 is formed with circumferential grooves 50, as shown in FIG. 3. The braided wire 13 enters the grooves 50 to improve a fixing force to the shielded cable 10.

A cover crimping portion 51 is provided behind the braided wire crimping portion 49 and can be crimped, bent or folded into connection with the outer cover 14 of the shielded cable 10. The outer cover crimping portion 51 includes two outer cover crimping pieces 51A, and is formed with a biting portion 52 by making a cut and bending the cut portion in. The biting portion 52 bites in the outer cover 14 to improve a fixing force to the shielded cable 10.

A connector 60 has a housing 61 and a retainer 62 to be mounted in the housing 61. The housing 61 is made e.g. of a synthetic resin and has a cylindrical shape that is long in forward and backward directions (see also FIG. 1). Three cavities 63 are arranged substantially at corners of an imaginary triangle in the housing 61 and can receive the shield terminals T.

Each cavity 63 has a substantially round cross section and is elongated in forward and backward directions. The rear end of each cavity 63 defines a terminal insertion opening 63A. The shield terminal T can be inserted through the insertion opening 63A and into the cavity 63 from behind and along the inserting direction.

A retainer mounting portion 64 is open at the front of the housing 61 and the retainer 62 can be mounted into 62 the retainer mounting portion 64 from the front, as shown in FIG.

1. The retainer mounting portion 64 is wide and communicates with the respective cavities 63.

A lock 65 cantilevers forward in each cavity 63 and a deformation space 66 is provided at a side of each lock 65 opposite the cavity 63. The lock 65 is resiliently deformable toward the deformation space 66. The deformation space 66 communicates with the retainer mounting portion 64.

A locking section 65A is provided at the side of the lock 65 opposite the deformation space 66 and projects into an insertion path for the shield terminal T. The locking section 65A engages the main portion 41 of the shield terminal T that has been inserted to a proper depth in the inserting direction ID for retaining the shield terminal T.

Guiding grooves 67 are formed at the opposite sides of each lock 65 and extend from the terminal insertion opening 63A of the cavity 63 to the front end. Each guiding groove 67 is formed with a substantially right-angled corner for receiving the leading folded end of the stabilizer 46.

The retainer 62 is mounted from the front and into the front part of the housing 61. The retainer 62 is made e.g. of synthetic resin and includes a fitting portion 68 that can fit into the retainer mounting portion 64. Parts of the fitting portion 68 that face the respective cavities 63 have a dented shape in conformity with the shape of the cavities 63 of the housing 61 including the guiding grooves 67, thereby forming parts of the front ends of the cavities 63.

Projecting pieces 69 project back from the rear surface of the fitting portion 68 of the retainer 62. The projecting pieces 69 are insertable into the deformation spaces 66 for the respective locks 65 to prevent deformation of the respective locks 65 towards the corresponding deformation spaces 66. The retainer 62 can be held at a partial locking position where the projecting pieces 69 are located before the deformation spaces 66 and a full locking position where the projecting pieces 69 are in the deformation spaces 66.

The inner conductors 20, the dielectric elements 30 and the outer conductors 40 of the shield terminals T are formed, assembled and connected with the ends of the shielded cables 10. Several shielded terminals T and shielded cables 10 connected thereto then are bundled together for transport to a production site for the connector 60. As a result, the outer conductors 40 packed together of the shield terminals T touch each other during the transportation. If the stabilizers 46 were in the form of single plates that were not folded back, then the extending end of the stabilizer 46 of one outer conductor 40 might enter the slit 43 of another outer conductor 40 during the transportation. Further, the extending ends of the stabilizers 46 commonly have fractured surfaces caused by the punching of the metal plate. Thus, the extending ends would easily get caught by the slits 43, and there would be a possibility that the tongue pieces 44 and/or the stabilizers 46 would be deformed inadvertently by the stabilizer 46 entering the slit 43 or getting caught. However, the stabilizer 46 of the subject invention is folded back at least once at an intermediate position so that the extending end of the stabilizer 46 faces the main portion 41, and so that the fold defines the leading end of the stabilizer 46. Thus, the thickness of the leading end of the stabilizer 46 is larger as compared to conventional stabilizers, and the leading end is unlikely to enter the slit 43. Further, since the extending end having the fractured surface resulting from the punching of the metal plate faces the main portion 41, and is unlikely to get caught by the slit 43 as compared to the case where the fractured surface is exposed to the outside. Therefore, inadvertent deformations of the tongue pieces 44 and the stabilizer 46 caused by the stabilizer 46 of one outer conductor 40 entering the slit 43 of another outer conductor or getting caught thereby can be prevented.

The retainer 62 is assembled at the partial locking position and then the shielded terminals T are inserted into the cavities 63 while being held in substantially horizontal postures. The shield terminal T could be oriented erroneously (e.g. upside down) with respect to the corresponding cavity 63. However, the stabilizer 46 of the shield terminal T will not align with the guiding groove 67 and will contact the edge of the terminal insertion opening 63A. The stabilizer 46 is at the front end of the main portion 41 with respect to the inserting direction ID. Thus, an attempt to insert the shield terminal T upside down into the cavity 63 can be noticed soon.

The main portion 41 of the outer conductor 40 of a properly oriented shield terminal T moves beyond the locking section 65A of the lock 65 of the cavity 63 and the lock 65 resiliently restores to engage the locking section 65A with the rear edge of the main portion 41 from behind. At this time, the front end of the shield terminal T already has reached the fitting portion 68 of the retainer 62 held at the partial locking position and the stabilizer 46 is in the guiding groove 67 in the retainer 62 or the housing 61.

The retainer 62 is pushed to the full locking position after inserting the respective shield terminals T to proper positions. As a result, the projecting pieces 69 of the retainer 62 enter the deformation spaces 66 to prevent the resilient deformations of the locking portions 65 and to redundantly retain the shield terminals T. At this time, the stabilizers 46 of the shield terminals T are at positions near the front ends of the guiding grooves 67 to prevent the main portions 41 from turning or rotating around their longitudinal axes. Therefore the shield terminals T are held and prevented from turning. The stabilizer 46 doubles as a stopper for turning movements in the shield terminal T provided with the cylindrical outer conductor 40. Hence, the construction of the outer conductor 40 is simplified as compared to the case where the stopper and the stabilizer 46 are provided separately.

Figure 8:
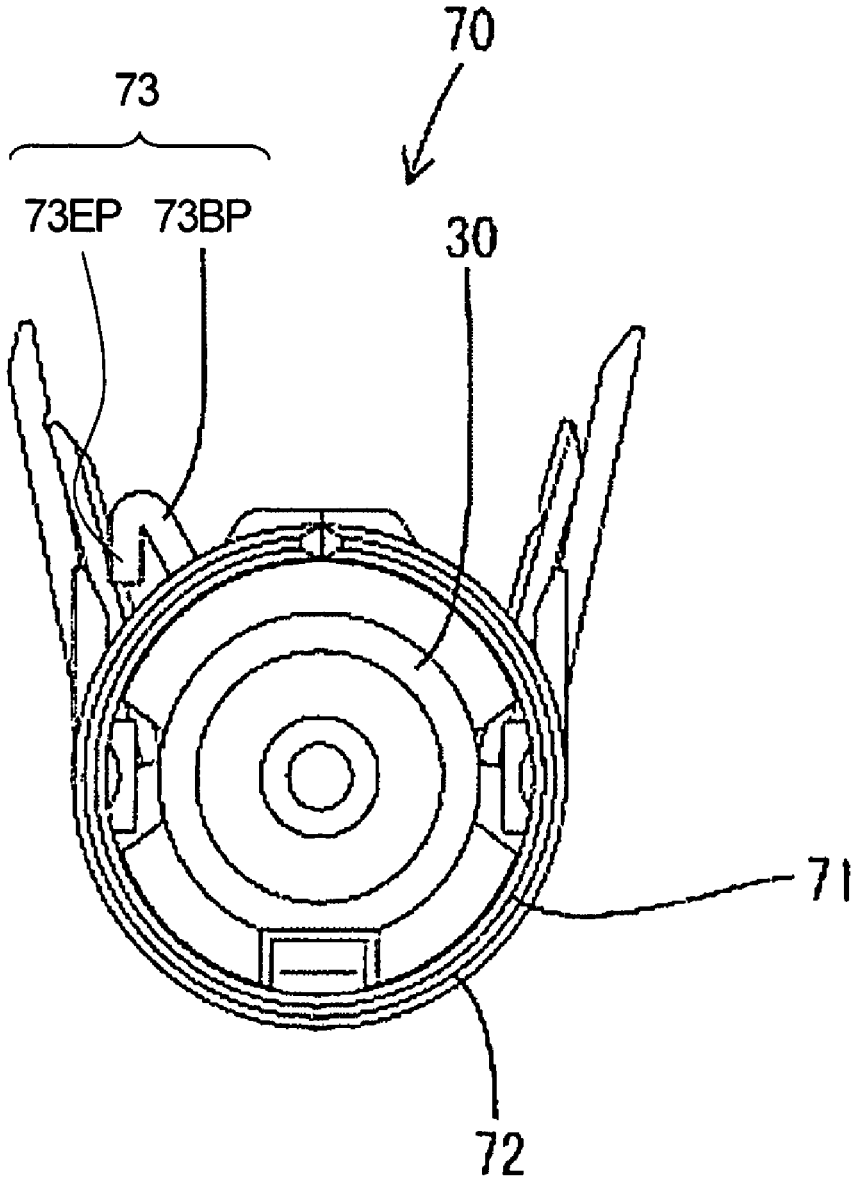
FIG. 8 is a front view of a shield terminal of a second embodiment.

A shield terminal 70 according to a second embodiment of the invention is described with reference to FIG. 8. The shield terminal 70 has a stabilizer 73 with a folded end shaped differently from the folded end of the stabilizer 46 of the first embodiment. Elements of the second embodiment that are the same as or similar to the first embodiment are identified by the same reference numerals, but are not described again.

The shield terminal 70 of the second embodiment has an outer conductor 71, an inner conductor 20 and a dielectric element 30 and is connected with an end of a shielded cable 10. The stabilizer 73 extends out at the front end of a main portion 72 of the outer conductor 71, and has an extending end portion 73EP folded at an intermediate position to be arranged at an angle to a base portion 73BP and to face the main portion 72 after extending from the side surface of the main portion 72 at a substantially right angle. In other words, the extending end portion 73EP of the stabilizer 73 is arranged at an angle to the base portion 73BP of the stabilizer 73. The shape of the folded end of the stabilizer 73 differs from the first embodiment, and spacing between the base side 73BE of the stabilizer 73 and the folded side 73EP thereof gradually widens toward the extending end. The folded end serves as the leading end of the stabilizer 73 similar to the first embodiment, and the extending end of the folded part reaches a position near the side surface of the main portion 72. This stabilizer 73 is shaped so that the thickness gradually increases towards the extending end 73EP and towards the main portion 72 from the folded end that has about twice the thickness of the metal plate.

As described above, the folded leading end of the stabilizer 73 is unlikely to enter the slit 43 because of the increased thickness as compared to conventional stabilizers. Further, the stabilizer 73 is formed to define a V-shape extending from the fold so that the thickness of the stabilizer 73 is increased gradually towards the main portion 72. Thus, the stabilizer 73 is less likely to enter the slit 43, and inadvertent deformations of the tongues 44 and the stabilizers 73 by the stabilizer 46 of one outer conductor 71 entering the slit 43 of the other outer conductor 71 or getting caught thereby can be prevented.

The invention is not limited to the above described and illustrated embodiments. For example, the following embodiments also are embraced by the invention defined by the claims. Various other changes can be made without departing from the scope of the invention defined by the claims.

The stabilizer 46 (73) is formed at the front of the main portion 41 (72) in the foregoing embodiments. However, the invention is not limited thereto and it may be spaced from the front end of the main portion.

The invention is applied to the outer conductor 40 (71) of the shield terminal T (70) in the foregoing embodiments. However, the invention is not limited thereto and is applicable to various terminal fittings.

The invention is applied to the outer conductor 40 (71) including the cylindrical main portion 41 (72) in the foregoing embodiments. However, the invention is not limited thereto and is applicable to an outer conductor including a main portion substantially in the form of a rectangular or polygonal tube.

The stabilizer 46 (73) doubles as the stopper for turning movements in the foregoing embodiments. However, the invention is not limited thereto and such a stopper may be provided in addition to the stabilizer.

The stabilizer 46 (73) is provided at one position of the main portion 41 (72) in the foregoing embodiments. However, it may be provided at plural positions. For example, two stabilizers may be provided on the main portion.

Although a braided wire 13 has been described as a preferred shielding layer, it should be understood that the invention is also applicable with other shielding layers such as a conductive film.

The first embodiment the shielded cable 10 includes the stabilizer 46 folded back at least once at the intermediate position so that the extending end thereof faces the main portion 41. However, the stabilizer need not be folded back completely, and only a portion thereof along the inserting direction ID may be folded back. Furthermore, the folding does not necessarily have to be such that the folded back portion is arranged completely substantially in surface contact with the remaining portion thereof not being folded back, but there may be a slight gap between the folded and the non-folded portion thereof.

What is claimed is:

1. A terminal fitting formed from a unitary piece of conductive material, comprising:

a wire connecting portion to be connected with a wire, the wire connecting portion having at least first and second substantially planar crimping pieces extending transversely out relative to a longitudinal direction of the wire in first and second transverse directions respectively;

a main portion to be inserted into a cavity of a housing, the main portion being substantially cylindrical;

at least one tongue formed by making a slit in a side surface of the main portion, the slit having a selected length and a selected width; and a stabilizer having a first plate unitary with the substantially cylindrical main portion and extending substantially radially out from the main portion substantially in the first direction so that the stabilizer is substantially aligned with the first crimping piece, the stabilizer further having a second plate extending unitarily from the first plate at a fold spaced outwardly from the main portion, the second plate being in substantially face-to-face relationship with the first plate such that an extending end of the second plate substantially faces the main portion, the first and second plates of the stabilizer having a length along the fold that is less than the length of the slit and defining a combined thickness that exceeds the width of the slit in the side surface of the main portion whereby the combined thickness of the stabilizer prevents the stabilizer of the terminal fitting from being inserted into a slit of another terminal fitting, and the stabilizer functions as a stopper for preventing a turning movement of the substantially cylindrical main portion.

2. The terminal fitting of claim 1, wherein the stabilizer has an extending end portion folded at an intermediate position to be arranged at an angle with respect to a base portion thereof.

3. The terminal fitting of claim 2, wherein the stabilizer has a thickness that gradually increases at positions farther from the folded end to define a thickness at least twice the thickness of the metal plate.

4. A shield terminal for connection with an end of a shielded cable having a core covered by a shielding layer, the shield terminal comprising:

an inner conductor to be connected with the core a dielectric element accommodating the inner conductor; and an outer conductor accommodating the dielectric element and to be connected with the shielding layer, the outer conductor having a substantially cylindrical main portion to be inserted into a cavity of a housing, at least one tongue formed by making a slit in a side surface of a main portion, the slit having a selected length and a selected width and a stabilizer extending substantially radially out from the substantially cylindrical main portion, the stabilizer having a first plate unitary with the main portion and extending out from the main portion, the stabilizer further having a second plate extending unitarily from the first plate at a fold spaced outwardly from the main portion by a distance that is greater than a thickness of the outer conductor, the second plate being in substantially face-to-face relationship with the first plate so that an extending end thereof substantially faces the main portion, the first and second plates of the stabilizer defining a length measured substantially parallel to the fold that is less than the length of the slit and defining a combined thickness that exceeds the width of the slit in the side surface, whereby the combined thickness of the stabilizer prevents the stabilizer of the shield terminal from being inserted into a slit of another shield terminal, first and second substantially planar crimping pieces extending out transverse to a longitudinal direction of the shielded cable, at least part of the stabilizer defining a plane aligned substantially radially to the core of the cable and being at a circumferential position relative to the core so that the plane of the stabilizer converges towards the substantially planar first crimping piece and so that the stabilizer occupies a dead space required for the crimping piece.

* * * * *